US011367386B1

(12) United States Patent
Shih et al.

(10) Patent No.: US 11,367,386 B1
(45) Date of Patent: Jun. 21, 2022

(54) LIGHT SENSING PIXEL AND DISPLAY DEVICE WITH LIGHT SENSING FUNCTION

(71) Applicant: AU Optronics Corporation, Hsin-Chu (TW)

(72) Inventors: Li-Wei Shih, Hsin-Chu (TW); Po-Chun Lai, Hsin-Chu (TW)

(73) Assignee: AU OPTRONICS CORPORATION, Hsin-Chu (TW)

( * ) Notice: Subject to any disclaimer, the term of this patent is extended or adjusted under 35 U.S.C. 154(b) by 0 days.

(21) Appl. No.: 17/518,599

(22) Filed: Nov. 4, 2021

(30) Foreign Application Priority Data

Jun. 23, 2021 (TW) ..... 110122963

(51) Int. Cl.
*G09G 3/32* (2016.01)

(52) U.S. Cl.
CPC ..... *G09G 3/32* (2013.01); *G09G 2300/0819* (2013.01); *G09G 2300/0842* (2013.01); *G09G 2360/141* (2013.01); *G09G 2360/145* (2013.01)

(58) Field of Classification Search
CPC ..... G09G 3/32; G09G 2300/0819; G09G 2300/0842; G09G 2360/141; G09G 2360/145
See application file for complete search history.

(56) References Cited

U.S. PATENT DOCUMENTS 8,330,091 B2 12/2012 Chuang
8,835,829 B2 9/2014 Chuang
10,170,036 B2 * 1/2019 Kline ..... G03B 21/60
10,366,674 B1 * 7/2019 Levin ..... G09G 3/2003
2011/0090208 A1 4/2011 Long et al.
2018/0190192 A1 7/2018 Kwon et al.
2018/0301091 A1 * 10/2018 Kuang ..... G09G 3/3233
2019/0066580 A1 2/2019 Xu
2019/0066586 A1 * 2/2019 Zhou ..... G09G 3/3233
2019/0114972 A1 * 4/2019 Feng ..... H01L 27/3244
2019/0272785 A1 * 9/2019 Qian ..... G09G 3/3225
2021/0150985 A1 * 5/2021 Li ..... G09G 3/2003
2021/0183310 A1 6/2021 Hu et al.
2021/0201727 A1 7/2021 Ma

FOREIGN PATENT DOCUMENTS

TW I745014 B 11/2021

* cited by examiner

*Primary Examiner* — Andrew Sasinowski
(74) *Attorney, Agent, or Firm* — WPAT, PC

(57) ABSTRACT

A light sensing pixel including a first transistor, a compensation circuit, an output circuit, a capacitor and a light sensing circuit is provided. The control terminal of the first transistor is coupled with a first node. The first terminal of the first transistor is configured to receive a first operation voltage or a second operation voltage lower than the first operation voltage. The compensation circuit is configured to detect a threshold voltage of the first transistor, and is configured to form a diode-connected structure with the first transistor. The output circuit is coupled between the second terminal of the first transistor and a sensing line. The capacitor is coupled between the first node and the light sensing circuit. In response to the light sensing circuit is illuminated by light, the first terminal of the capacitor and the second terminal of the capacitor generate voltage variations simultaneously.

17 Claims, 9 Drawing Sheets

LIGHT SENSING PIXEL AND DISPLAY DEVICE WITH LIGHT SENSING FUNCTION

CROSS-REFERENCE TO RELATED APPLICATION

This application claims priority to Taiwan Application Serial Number 110122963, filed Jun. 23, 2021, which is herein incorporated by reference in its entirety.

BACKGROUND

Technical Field

The present disclosure relates to a pixel and a display device, especially a light sensing pixel and a display device with light sensing function.

Description of Related Art

In order to reduce the width of the frame of mobile devices or even remove the frame of mobile devices, light sensing pixels are widely integrated into the screen modules of mobile devices to achieve functions such as "fingerprint on display", detecting ambient light or detecting the aging degree of the light emitting element. Commonly used processes for screen modules of mobile devices include low-temperature polysilicon (LTPS), indium gallium zinc oxide (IGZO), and low-temperature polycrystalline oxide (LTPO), etc. However, these processes inevitably have the problem of non-uniform characteristics of transistors. In other words, the transistors in different regions of the screen module may have different component characteristics, which may reduce the accuracy of fingerprint recognition of the mobile device, or affect the function of the mobile device to adjust the display brightness according to the ambient light. In view of this, compensating for the variation of the component characteristics of the transistors is currently a problem to be solved.

SUMMARY

One aspect of the present disclosure is a light sensing pixel, comprising a first transistor, a compensation circuit, an output circuit, a capacitor and a light sensing circuit. The first transistor comprises a first terminal, a second terminal, and a control terminal coupled with a first node. The first terminal of the first transistor is configured to receive a first operation voltage or a second operation voltage lower than the first operation voltage. The compensation circuit is configured to detect a threshold voltage of the first transistor, and comprising at least one transistor configured to form a diode-connected structure with the first transistor. The output circuit is coupled between the second terminal of the first transistor and a sensing line. The capacitor comprises a first terminal and a second terminal. The first terminal of the capacitor is electrically coupled to the first node. The light sensing circuit is electrically coupled to the second terminal of the capacitor, wherein in response to the light sensing circuit is illuminated by light, the first terminal of the capacitor and the second terminal of the capacitor generate voltage variations simultaneously.

Another aspect of the present disclosure is a display device with light sensing function, comprising a plurality of display pixels and a plurality of light sensing pixels. The plurality of display pixels are arranged to form a pixel matrix, wherein each of the plurality of display pixels comprises a light emitting element. The plurality of light sensing pixels arranged in the pixel matrix. Each of the plurality of light sensing pixels comprises a first transistor, a compensation circuit, an output circuit, a capacitor and a light sensing circuit. The first transistor comprises a first terminal, a second terminal, and a control terminal coupled with a first node. The first terminal of the first transistor is configured to receive a first operation voltage or a second operation voltage lower than the first operation voltage. The compensation circuit is configured to detect a threshold voltage of the first transistor, and comprises at least one transistor configured to form a diode-connected structure with the first transistor. The output circuit is coupled between the second terminal of the first transistor and a sensing line. The capacitor comprises a first terminal and a second terminal. The first terminal of the capacitor is electrically coupled to the first node. The light sensing circuit is electrically coupled to the second terminal of the capacitor. In response to the light sensing circuit is illuminated by light, the first terminal of the capacitor and the second terminal of the capacitor generate voltage variations simultaneously.

One of the advantages of the above mentioned light sensing pixels and display devices is that it effectively compensates for the variation of the component characteristics of the transistors and provide highly reliable and stable light sensing results.

It is to be understood that both the foregoing general description and the following detailed description are by examples, and are intended to provide further explanation of the disclosure as claimed.

BRIEF DESCRIPTION OF THE DRAWINGS

The present disclosure can be more fully understood by reading the following detailed description of the embodiment, with reference made to the accompanying drawings as follows.

DETAILED DESCRIPTION

Figure 1:
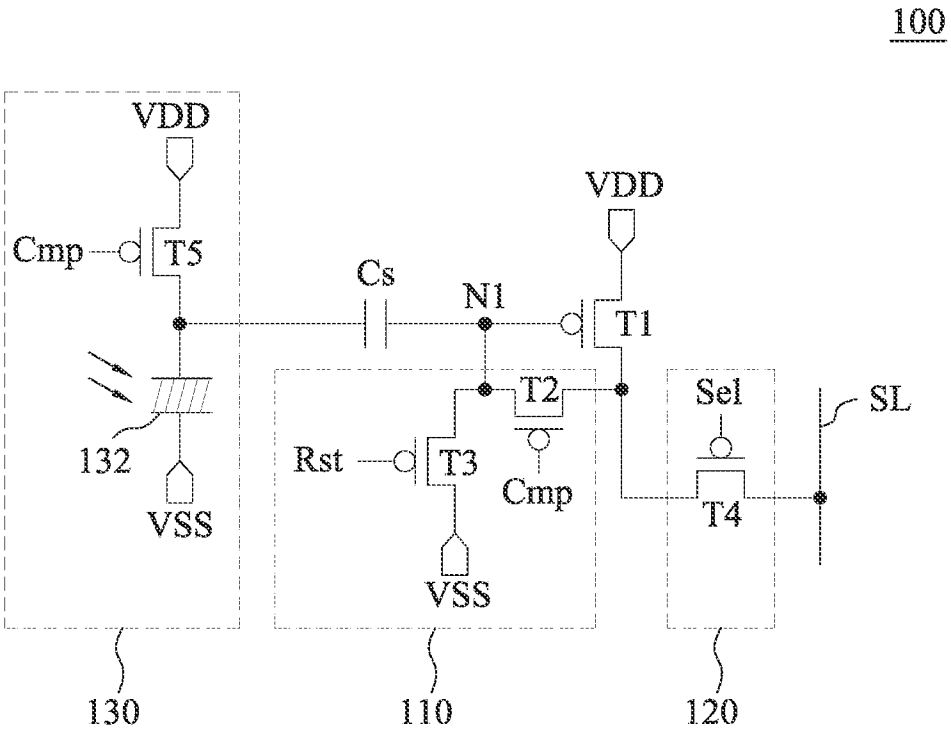
FIG. 1 is a schematic diagram of a light sensing pixel in some embodiments of the present disclosure.

The embodiments of the present disclosure will be described below in conjunction with related drawings. In the drawings, the same reference numerals indicate the same or similar elements or method flows.

FIG. 1 is a schematic diagram of a light sensing pixel in some embodiments of the present disclosure. The light sensing pixel 100 includes a first transistor T1, a compensation circuit 110, a output circuit 120, a light sensing circuit 130 and a capacitor Cs. The light sensing pixel 100 uses a first transistor T1 to convert the light sensing result into the corresponding output current (or output voltage). The first transistor T1 includes a first terminal, a second terminal and a control terminal. The first terminal of the first transistor T1 is configured to receive the first operation voltage VDD (e.g., high voltage), and the control terminal of the first transistor T1 is electrically coupled to a first node N1. The compensation circuit 110 is electrically coupled to the second terminal of the first transistor T1 and the first node N1. The compensation circuit 110 is configured to form a diode-connected structure with the first transistor T1, so as to detect the threshold voltage of the first transistor T1. The detailed detection method will be explained in the subsequent paragraphs.

The output circuit 120 is electrically coupled between the second terminal of the first transistor T1 and a sensing line SL. The output circuit 120 is configured to selectively conduct the first transistor T1 to the sensing line SL, so as to transmit the output current generated by the first transistor T1 to the sensing line SL. In some embodiments, the sensing line SL can further transmit the output current to the signal processing circuit including an integrator, analog-to-digital converter and a suitable logic circuit (e.g., a signal processing circuit 630 in FIG. 6 described later).

The first terminal of the capacitor Cs is electrically coupled to the first node N1, and the second terminal of the capacitor Cs is electrically coupled to the light sensing circuit 130. The light sensing circuit 130 is configured to correspondingly change the voltage of the second terminal of the capacitor Cs in response to illumination of light. In some situations, when the second terminal of the capacitor Cs has a voltage variation, the first terminal of the capacitor Cs (or the first node N1) will also generate a substantially equal voltage variation, so that the output current of the first transistor T1 can represent the intensity of light illuminating the light sensing circuit 130.

The circuit structure of the light sensing pixel 100 will be described below. In some embodiments, the compensation circuit 110 includes a second transistor T2 and a third transistor T3. The second transistor T2 and the third transistor T3 respectively includes a first terminal, a second terminal and a control terminal. The first terminal of the second transistor T2 is electrically coupled to the first node N1. The second terminal of the second transistor T2 is electrically coupled to the second terminal of the first transistor T1. The control terminal of the second transistor T2 is configured to receive a compensation control signal Cmp. In other words, when the second transistor T2 is turned on, the second transistor T2 will form a diode-connected structure with the first transistor T1. In addition, the first terminal of the third transistor T3 is electrically coupled to the first node N1, the second terminal of the third transistor T3 is configured to receive a second operation voltage VSS (e.g., low voltage), and the control terminal of the third transistor T3 is configured to receive a reset control signal Rst.

In some embodiments, the output circuit 120 includes a fourth transistor T4. The fourth transistor T4 includes a first terminal, a second terminal and a control terminal. The first terminal of the fourth transistor T4 is electrically coupled to the sensing line SL, the second terminal of the fourth transistor T4 is electrically coupled to the second terminal of the first transistor T1, and the control terminal of the fourth transistor T4 is configured to receive the output control signal Sel.

In some embodiments, the light sensing circuit 130 includes a fifth transistor T5 and a light sensing element 132. The fifth transistor T5 includes a first terminal, a second terminal and a control terminal. The first terminal of the fifth transistor T5 is configured to receive a first operation voltage VDD, the second terminal of the fifth transistor T5 is electrically coupled to the second terminal of the capacitor Cs, and the control terminal of the fifth transistor T5 is configured to receive the compensation control signal Cmp. The first terminal of the light sensing element 132 is electrically coupled to the second terminal of the capacitor Cs, the second terminal of the light sensing element 132 is configured to receive the second operation voltage VSS.

In some embodiments, the first transistors T1-T5 of the light sensing pixel 100 can be implemented by P-type transistor, such as P-type low-temperature polycrystalline silicon thin film transistors (LTPS TFT). In some other embodiments, the light sensing element 132 can be implemented by a P-type transistor with diode-connected structure, such as a P-type LTPS TFT with diode-connected structure.

Figure 2:
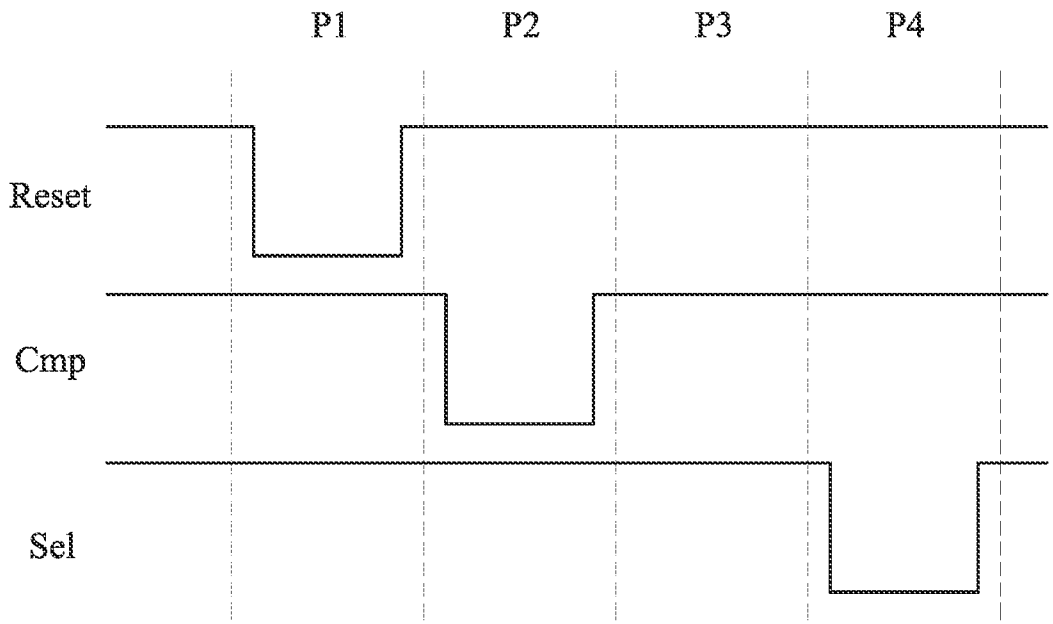
FIG. 2 is a simplified waveform diagram of the control signal of the light sensing pixel in some embodiments of the present disclosure.

FIG. 2 is a simplified waveform diagram of the control signal of the light sensing pixel 100 in FIG. 1 in some embodiments of the present disclosure. FIG. 3A-FIG. 3D are schematic diagrams of the equivalent circuit operation of the light sensing pixel in multiple phases. The operation of the light sensing pixel 100 will be described below with reference to FIG. 2 and FIG. 3A-FIG. 3D.

Figure 3A:
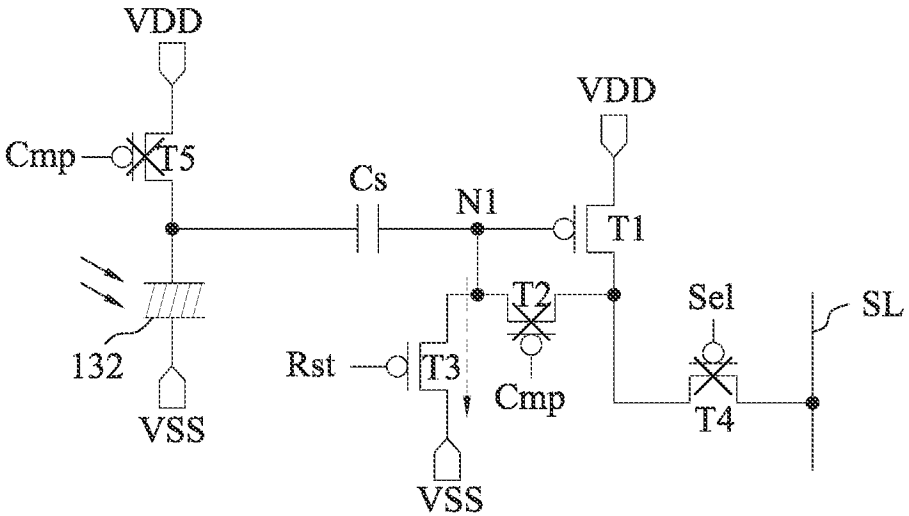
FIG. 3A is a schematic diagram of the equivalent circuit operation of the light sensing pixel in the reset phase.

Please refer to FIG. 2 and FIG. 3A first. In a reset phase P1, the reset control signal Rst is logic high level, such as a low voltage that can turn on a P-type transistor. On the other hand, the compensation control signal Cmp and the output control signal Sel are logic low level, such as a high voltage that can turn off the P-type transistor. Therefore, the first transistor T1 and the third transistor T3 will be turned on, and the second transistor T2, the fourth transistor T4 and the fifth transistor T5 will be turned off, so that the first node N1 is reset to the second operation voltage VSS.

Figure 3B:
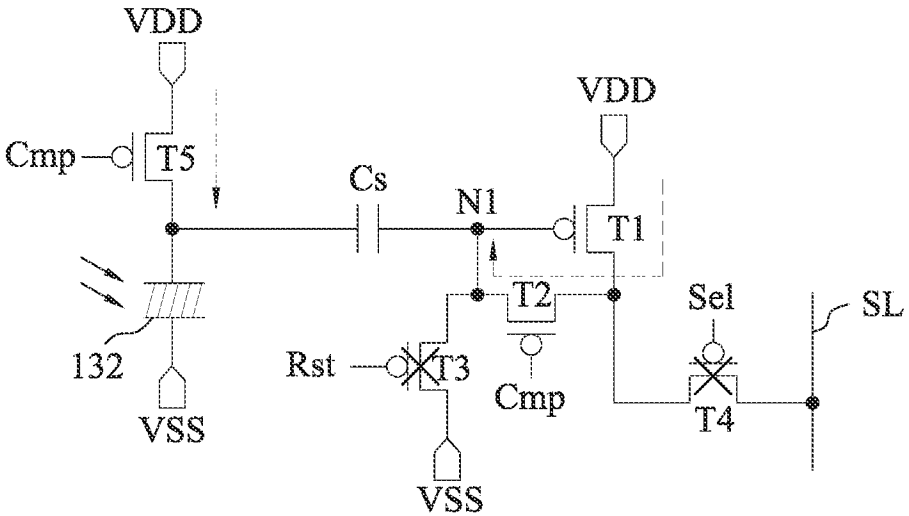
FIG. 3B is a schematic diagram of the equivalent circuit operation of the light sensing pixel in the compensation phase.

Next, please refer to FIG. 2 and FIG. 3B, in a compensation phase P2, the compensation control signal Cmp has a logic high level. The reset control signal Rst and the output control signal Sel have a logic low level. Therefore, the first transistor T1, the second transistor T2 and the fifth transistor T5 will be turned on, and the third transistor T3 and the fourth transistor T4 will be turned off. At this time, the first node N1 will be charged to the voltage shown in the following "Formula 1":

$$V_{N1}=VDD-|Vth1| \qquad \text{Formula 1}$$

The symbol "$V_{N1}$" in "Formula 1" is configured to indicate the voltage of the first node N1. The symbol "Vth1" is configured to indicate the threshold voltage of the first transistor T1. According to "Formula 1", the compensation circuit 110 detects the threshold voltage of the first transistor T1 in the compensation phase P2, and stores the detected threshold voltage in the first node N1.

Figure 3C:
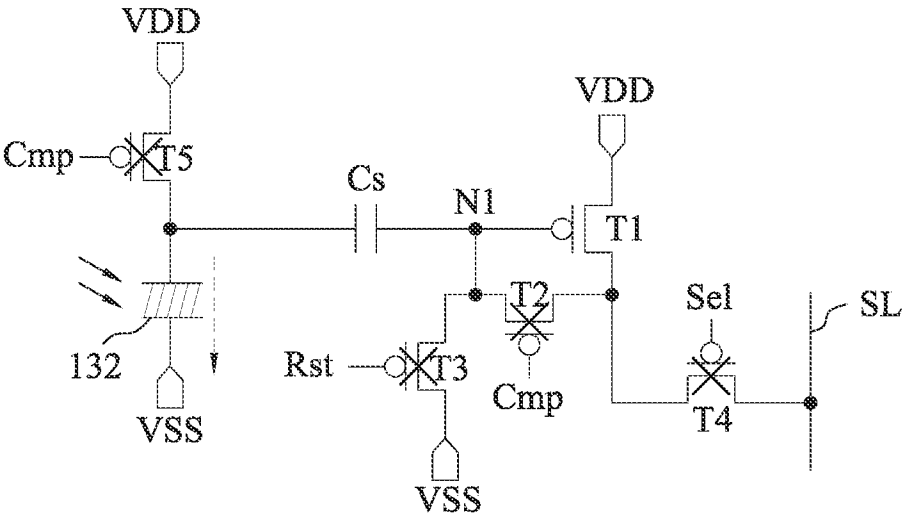
FIG. 3C is a schematic diagram of the equivalent circuit operation of the light sensing pixel in the sensing phase.

Next, please refer to FIG. 2 and FIG. 3C. In the sensing phase P3, the reset control signal Rst, the compensation control signal Cmp and the output control signal Sel all have logic low levels to turn off the second transistor T2 to the fifth transistor T5. At this time, when the light sensing element 132 is illuminated by light, the light sensing element 132 will generate a sensing current flowing from the first terminal of the light sensing element 132 to the second terminal of the light sensing element 132. In some embodiments, the magnitude of the sensing current is positively related to the intensity of light illuminating the light sensing element 132. At this time, the voltage variation of the second terminal of the capacitor Cs (left end) will be transmitted to the first terminal of the capacitor Cs (right end, that is the first node N1) through the capacitor coupling. In other words, the first terminal of the capacitor Cs and the second terminal of the capacitor Cs can simultaneously generate voltage variations in the sensing phase P3, so that the first node N1 has a voltage as shown in the following "Formula 2":

$$V_{N1}=VDD-|Vth1|+\Delta V \quad \text{Formula 2}$$

The symbol "ΔV" in "Formula 2" is configured to indicate that the first terminal of the capacitor Cs has the same voltage variations as the second terminal, but the present disclosure is not limited by this. In some embodiments, the voltage variation of the first terminal of the capacitor Cs and the second terminal can be different. For example, the first node N1 can be additionally coupled to the capacitor to improve the voltage stability of the first node N1.

Figure 3D:
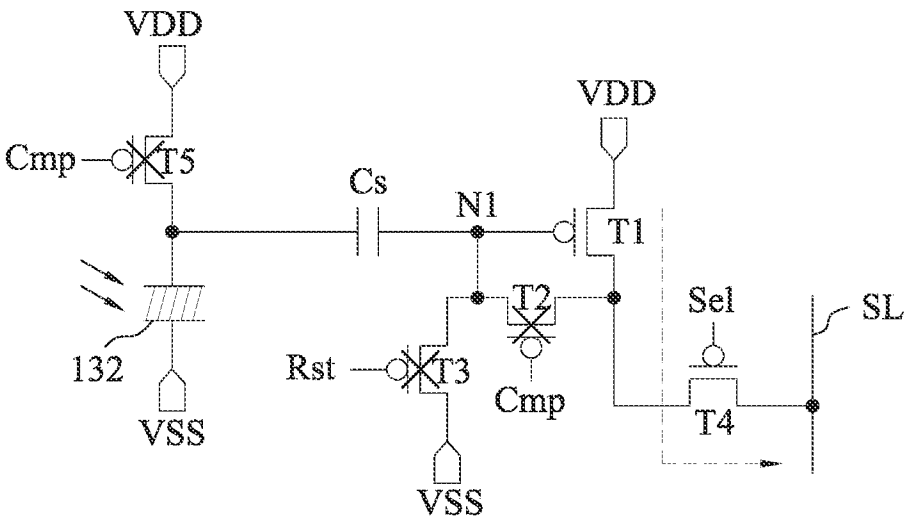
FIG. 3D is a schematic diagram of the equivalent circuit operation of the light sensing pixel in the output phase.

Next, please refer to FIG. 2 and FIG. 3D. In the output phase P4, the output control signal Sel has a logic high level. The reset control signal Rst and the compensation control signal Comp have a logic low level. Therefore, the first transistor T1 and the fourth transistor T4 will be turned on, and the second transistor T2, the third transistor T3 and the fifth transistor T5 will be turned off. At this time, the first transistor T1 is operating in the saturation region, and the output current generated by the first transistor T1 (indicated by the dashed arrow in FIG. 3D) will be transmitted to the sensing line SL through the fourth transistor T4. The output current of the first transistor T1 can be expressed by the following "formula 3":

$$I_{OUT}=K(VDD-V1-|Vth1|)^2=K(\Delta V)^2 \quad \text{formula 3}$$

The symbol "$I_{OUT}$" in "Formula 3" is configured to indicate the output current of the first transistor T1, and the symbol "K" is configured to indicate a conduction parameter. It can be seen from "Formula 3" that the threshold voltage of the first transistor T1 hardly affects the output current of the first transistor T1. Therefore, the light sensing pixel 100 in FIG. 1 can effectively compensate for the variation of the component characteristics of the transistor, and provide highly reliable and stable light sensing results.

Figure 4:
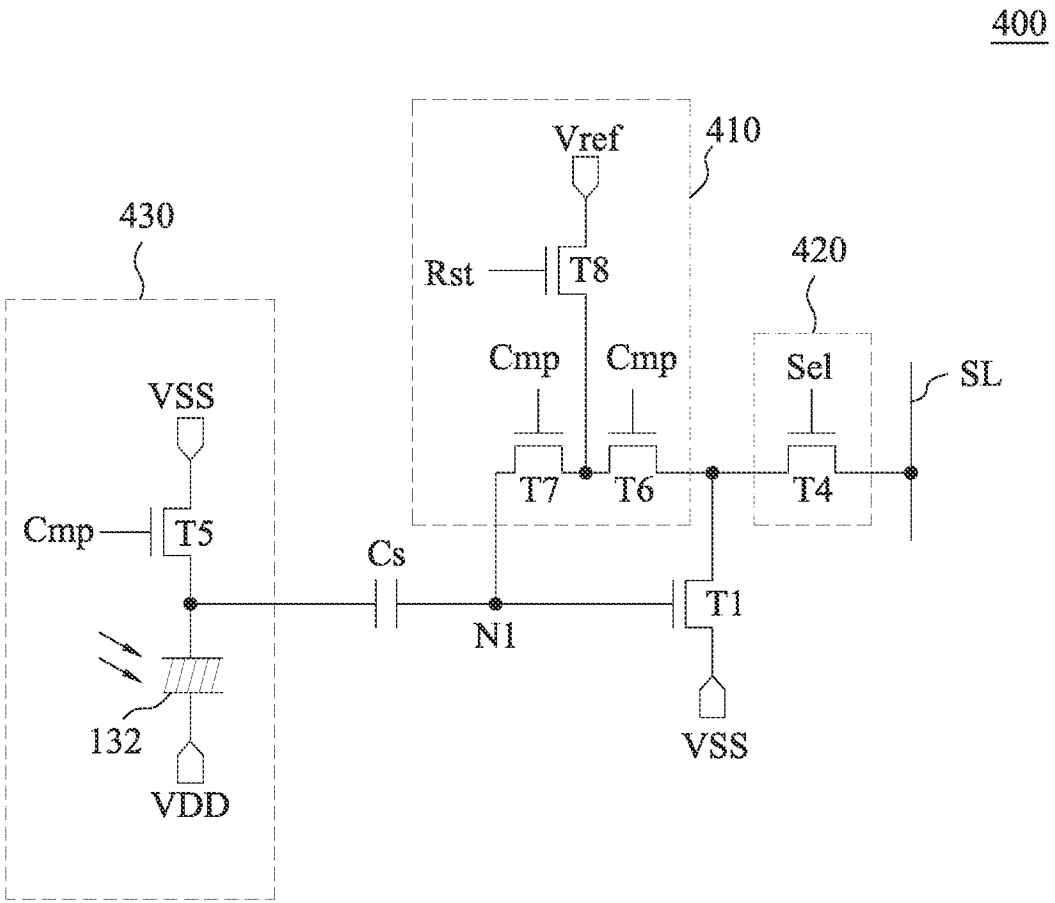
FIG. 4 is a functional block diagram of the light sensing pixel in some embodiments of the present disclosure.

FIG. 4 is a functional block diagram of the light sensing pixel 400 in some embodiments of the present disclosure. The light sensing pixel 400 includes a first transistor T1, a compensation circuit 410, a output circuit 420, a light sensing circuit 430 and a capacitor Cs. The first terminal of the first transistor T1 is configured to receive the second operation voltage VSS (e.g., low voltage), and the control terminal of the first transistor T1 is electrically coupled to the first node N1.

The compensation circuit 410 is electrically coupled to the second terminal of the first transistor T1 and the first node N1, and is configured to detect the threshold voltage of the first transistor T1. In some embodiments, the compensation circuit 410 includes a sixth transistor T6, a seventh transistor T7 and a eighth transistor T8. The sixth transistor T6, the seventh transistor T7 and the eighth transistor T8 respectively include a first terminal, a second terminal and a control terminal. The first terminal of the sixth transistor T6 is electrically coupled to the second terminal of the first transistor T1, and the control terminal of the sixth transistor T6 is configured to receive the compensation control signal Cmp. The first terminal of the seventh transistor T7 is electrically coupled to the second terminal of the sixth transistor T6, the second terminal of the seventh transistor T7 is electrically coupled to the first node N1, and the control terminal of the seventh transistor T7 is configured to receive the compensation control signal Cmp. The first terminal of the eighth transistor T8 is configured to receive a reference voltage Vref, the second terminal of the eighth transistor T8 is electrically coupled to the second terminal of the seventh transistor T7, and the control terminal of the eighth transistor T8 is configured to receive the reset control signal Rst.

The output circuit 420 is electrically coupled between the second terminal of the first transistor T1 and the sensing line SL. The components and connection method of the output circuit 420 are similar to the output circuit 120 in FIG. 1, so the details are not repeated here.

The first terminal of the capacitor Cs and the second terminal are electrically coupled to the first node N1 and the light sensing circuit 430, respectively. The light sensing circuit 430 is electrically coupled to the second terminal of the capacitor Cs. The components and connections of the light sensing circuit 430 are similar to the light sensing circuit 130 in FIG. 1, the difference is that, the first terminal of the light sensing circuit 430 of the fifth transistor T5 is configured to receive the second operation voltage VSS, and the second terminal of the light sensing element 132 in the light sensing circuit 430 is configured to receive the first operation voltage VDD.

In some embodiments, the transistors T4-T8 of the light sensing pixel 400 can be implemented by N-type transistor, such as a N-type indium gallium zinc oxide thin film transistor (IGZO TFT). In some other embodiments, the light sensing element 132 can be implemented by a N-type transistor with diode-connected structure, such as a N-type IGZO TFT with diode-connected structure.

Figure 5:
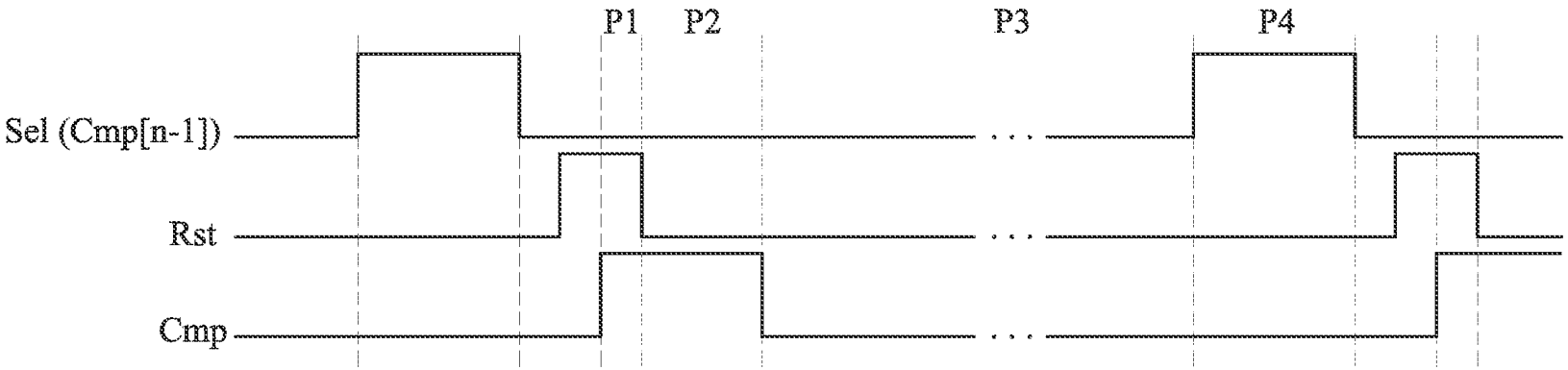
FIG. 5 is a simplified waveform diagram of the control signal of the light sensing pixel in some embodiments of the present disclosure.

FIG. 5 is a simplified waveform diagram of the control signal of the light sensing pixel 400 in FIG. 4 in some embodiments of the present disclosure. In this embodiment, the logic high level of the output control signal Sel, the compensation control signal Cmp and the output control signal Sel can be a high voltage that can turn on the N-type transistor, and the logic low level of the output control signal Sel, the compensation control signal Cmp and the output control signal Sel can be a low voltage that can turn off the N-type transistor. As shown in FIG. 5, the operation of the light sensing pixel 400 includes: a reset phase P1 resetting the first node N1 to the reference voltage Vref; a compensation phase P2 detecting the threshold voltage of the first transistor T1 and storing the threshold voltage; a sensing phase P3 detecting the light intensity and generating a voltage variation corresponding to the light intensity at two terminals of the capacitor Cs simultaneously; a output phase P4 using the first transistor T1 to convert the sensing result into output current.

It is should be note that when multiple light sensing pixels 400 are arranged to form a light sensing matrix, the output control signal Sel of the light sensing pixel 400 transmitted to a certain row of the light sensing matrix may be the compensation control signal Cmp[n−1] of the previous stage. The compensation control signal Cmp[n−1] of the previous stage will be transmitted to the fifth transistor T5, the sixth transistor T6 and the seventh transistor T7 of the light sensing pixel 400 of the previous row of the certain row. Therefore, the compensation control signal Cmp and the output control signal Sel of the light sensing pixel 400 can be generated by the same shift register to reduce circuit layout area. The other advantages of the light sensing pixel 100 mentioned above are all applicable to the light sensing pixel 400. For simplicity's sake, the details will not be repeated.

Figure 6:
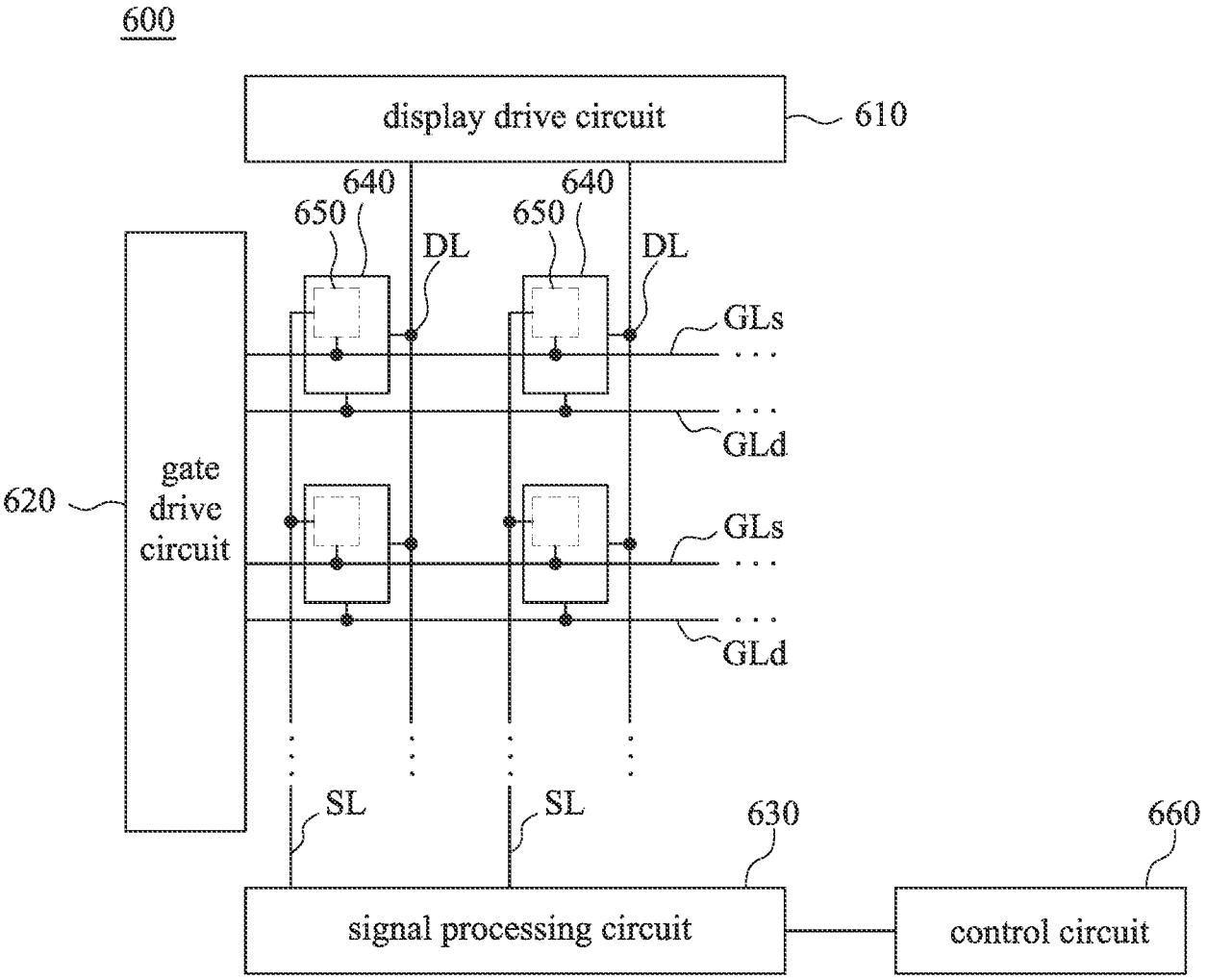
FIG. 6 is a simplified functional block diagram of a display device with light sensing function in some embodiments of the present disclosure.

FIG. 6 is a simplified functional block diagram of a display device 600 with light sensing function in some embodiments of the present disclosure. The display device 600 includes a display drive circuit 610, a gate drive circuit 620, a signal processing circuit 630, multiple display pixels 640, multiple light sensing pixels 650, a control circuit 660, multiple data lines DL, multiple show gate lines GLd, multiple sense gate lines GLs and multiple sensing lines SL. For simplicity's sake, other components and connection relationships in the display device 600 are not shown in FIG. 6.

Multiple display pixels 640 are arranged to form to the pixel matrix, and each of the display pixels 640 includes a light emitting element (not shown in the figure, such as organic light emitting diodes or micro light emitting diodes). The light sensing pixels 650 are arranged in the pixel matrix. In the FIG. 6, the display pixels 640 and the light sensing pixel 650 have the same number, but the present disclosure is not limited to this. In practice, the number of the light sensing pixels 650 can be less than the number of the display pixels 640. For example, only one the light sensing pixel 650 is provided in an area containing dozens of the display pixels 640. In some embodiments, the light sensing pixel 650 can be implemented by the light sensing pixel 100 in FIG. 1 or the light sensing pixel 400 in FIG. 4.

The display drive circuit 610 is configured to provide the data voltage to the display pixels 640 by the data lines DL, so as to set the grayscale value of the display pixels 640. In some embodiments, the display drive circuit 610 includes a timing controller (TCON) configured to generate the clock required for the operation of the display device 600.

The gate drive circuit 620 is configured to drive the display pixels 640 by the show gate lines GLd, so as to control the display pixels 640 to update the data voltage and/or the threshold voltage, and/or control to detect and/or emit light, etc. The gate drive circuit 620 is further configured to transmit the above compensation control signal Cmp, the reset control signal Rst and the output control signal Sel to the light sensing pixel 650 by the sense gate lines GLs. For simplicity's sake, each of the display pixels 640 in FIG. 6 is only connected to one show gate line GLd, and each of the light sensing pixel 650 is only connected to one sense gate line GL, but the present disclosure is not limited to this. Each of the show gate lines GLd can be a collection of multiple lines to transmit multiple different control signals. Similarly, each of the sense gate lines GLs can be a collection of multiple lines to transmit the compensation control signal Cmp, the reset control signal Rst and the output control signal Sel.

The signal processing circuit 630 is configured to receive the output current of the light sensing pixel 650 by multiple sensing lines SL, and convert the output current into a corresponding digital signal and outputs it to the control circuit 660. The control circuit 660 analyzes the light intensity according to the received digital signal, and then controls the operation of the display device 600 according to the light intensity.

For example, in this embodiment, the display pixels 640 are covered on the light sensing pixel 650. In other words, the projection area formed by the vertical projection of the light sensing element 132 of each of the light sensing pixels 650 onto a plane (not shown) will be located in a projection area, which is formed by the vertical projection of the light emitting element of a corresponding one of the display pixels 640 onto the plane. Therefore, the control circuit 660 determines the aging degree (the degree of brightness attenuation) of the light emitting element of the display pixels 640 according to the light sensing result of the light sensing pixel 650, and adjusts the data voltage output by the display drive circuit 610. If the light emitting element of the display pixels 640 is light-transmissive, such as an organic light-emitting diode, the control circuit 660 can also implement "fingerprint on display" or detecting ambient light according to the light sensing result of the light sensing pixel 650 when the display pixels 640 is not emitting light, and controls the display device 600 to unlock the screen or adjust the display brightness according to the ambient light.

In order to improve the accuracy of the ambient light detection, or to implement the "fingerprint on display" when the light emitting element of the display pixels 640 is not transparent, the display pixels 640 and the light sensing pixel 650 can also not overlap each other.

Specification and claim use certain term to refer to specific elements. However, those skilled in the art should understand that the same element may be called by different terms. The specification and claim do not use the difference in name as a way to distinguish elements, but use the difference in function of the components as the basis for distinction. The "include" mentioned in the specification and claim is an open term, so it should be interpreted as "including but not limited to". In addition, "couple" here includes any direct and indirect connection means. Therefore, if the first element is described as being coupled to the second element, it means that the first element can be directly connected to the second element through electrical connection, wireless transmission, optical transmission, or other signal connection methods, or it is electrically or signally connected to the second element indirectly through other elements or connection means.

The description of "and/or" used herein includes any combination of one or more of the listed items. In addition, unless otherwise specified in the specification, any term in the singular case also includes the meaning of the plural case.

The elements, method steps, or technical features in the foregoing embodiments may be combined with each other, and are not limited to the order of the specification description or the order of the drawings in the present disclosure. It will be apparent to those skilled in the art that various modifications and variations can be made to the structure of the present disclosure without departing from the scope or spirit of the present disclosure. In view of the foregoing, it is intended that the present disclosure cover modifications and variations of this present disclosure provided they fall within the scope of the following claims.

What is claimed is:

1. A light sensing pixel, comprising:

a first transistor comprising a first terminal, a second terminal, and a control terminal coupled with a first node, wherein the first terminal of the first transistor is configured to receive a first operation voltage or a second operation voltage lower than the first operation voltage;

a compensation circuit configured to detect a threshold voltage of the first transistor, and comprising at least one transistor configured to form a diode-connected structure with the first transistor;

an output circuit coupled between the second terminal of the first transistor and a sensing line;

a capacitor comprising a first terminal and a second terminal, wherein the first terminal of the capacitor is electrically coupled to the first node; and a light sensing circuit electrically coupled to the second terminal of the capacitor, wherein in response to the light sensing circuit is illuminated by light, the first terminal of the capacitor and the second terminal of the capacitor generate voltage variations simultaneously.

2. The light sensing pixel of claim 1, wherein when the first terminal of the first transistor is configured to receive the first operation voltage, the at least one transistor comprises:

a second transistor comprising a first terminal, a second terminal and a control terminal, wherein the first terminal of the second transistor is electrically coupled to the first node, the second terminal of the second transistor is electrically coupled to the second terminal of the first transistor, and the control terminal of the second transistor is configured to receive a compensation control signal.

3. The light sensing pixel of claim 2, wherein the compensation circuit further comprises:

a third transistor comprising a first terminal, a second terminal and a control terminal, wherein the first terminal of the third transistor is electrically coupled to the first node, the second terminal of the third transistor is configured to receive the second operation voltage, and the control terminal of the third transistor is configured to receive a reset control signal.

4. The light sensing pixel of claim 1, wherein when the first terminal of the first transistor is configured to receive the first operation voltage, the output circuit comprises:

a fourth transistor comprising a first terminal, a second terminal and a control terminal, wherein the first terminal of the fourth transistor is electrically coupled to the sensing line, the second terminal of the fourth transistor is electrically coupled to the second terminal of the first transistor, and the control terminal of the fourth transistor is configured to receive a output control signal.

5. The light sensing pixel of claim 1, wherein when the first terminal of the first transistor is configured to receive the first operation voltage, the light sensing circuit comprises:

a fifth transistor comprising a first terminal, a second terminal and a control terminal, wherein the first terminal of the fifth transistor is configured to receive the first operation voltage, the second terminal of the fifth transistor is electrically coupled to the second terminal of the capacitor, and the control terminal of the fifth transistor is configured to receive a compensation control signal; and a light sensing element comprising a first terminal and a second terminal, wherein the first terminal of the light sensing element is electrically coupled to the second terminal of the capacitor, and the control terminal of the light sensing element is configured to receive the second operation voltage.

6. The light sensing pixel of claim 1, wherein when the first terminal of the first transistor is configured to receive the second operation voltage, the at least one transistor comprises:

a sixth transistor comprising a first terminal, a second terminal and a control terminal, wherein the first terminal of the sixth transistor is electrically coupled to the second terminal of the first transistor, and the control terminal of the sixth transistor is configured to receive a compensation control signal; and a seventh transistor comprising a first terminal, a second terminal and a control terminal, wherein the first terminal of the seventh transistor is electrically coupled to the second terminal of the sixth transistor, the second terminal of the seventh transistor is electrically coupled to the first node, and the control terminal of the seventh transistor is configured to receive the compensation control signal.

7. The light sensing pixel of claim 6, wherein the compensation circuit further comprises:

a eighth transistor comprising a first terminal, a second terminal and a control terminal, wherein the first terminal of the eighth transistor is configured to receive a reference voltage, the second terminal of the eighth transistor is electrically coupled to the second terminal of the seventh transistor, and the control terminal of the eighth transistor is configured to receive a reset control signal.

8. The light sensing pixel of claim 1, wherein when the first terminal of the first transistor is configured to receive the second operation voltage, the light sensing circuit comprises:

a fifth transistor comprising a first terminal, a second terminal and a control terminal, wherein the first terminal of the fifth transistor is configured to receive the second operation voltage, the second terminal of the fifth transistor is electrically coupled to the second terminal of the capacitor, and the control terminal of the fifth transistor is configured to receive a compensation control signal; and a light sensing element comprising a first terminal and a second terminal, wherein the first terminal of the light sensing element is electrically coupled to the second terminal of the capacitor, and the control terminal of the light sensing element is configured to receive the first operation voltage.

9. A display device with light sensing function, comprising:

a plurality of display pixels arranged to form a pixel matrix, wherein each of the plurality of display pixels comprises a light emitting element; and a plurality of light sensing pixels arranged in the pixel matrix, wherein each of the plurality of light sensing pixels comprises:

a first transistor comprising a first terminal, a second terminal, and a control terminal coupled with a first node, wherein the first terminal of the first transistor is configured to receive a first operation voltage or a second operation voltage lower than the first operation voltage;

a compensation circuit configured to detect a threshold voltage of the first transistor, and comprising at least one transistor configured to form a diode-connected structure with the first transistor;

an output circuit coupled between the second terminal of the first transistor and a sensing line;

a capacitor comprising a first terminal and a second terminal, wherein the first terminal of the capacitor is electrically coupled to the first node; and a light sensing circuit electrically coupled to the second terminal of the capacitor, wherein in response to the light sensing circuit is illuminated by light, the first terminal of the capacitor and the second terminal of the capacitor generate voltage variations simultaneously.

10. The display device of claim 9, wherein each of the light sensing circuit comprises a light sensing element, and the light sensing element of each of the plurality of light sensing pixels is vertically projected onto a plane to form a first projection area, which is located in a second projection area formed by a vertical projection of the light-emitting element of a corresponding one of the plurality of light sensing pixels onto the plane.

11. The display device of claim 9, wherein when the first terminal of the first transistor is configured to receive the first operation voltage, the at least one transistor comprises:

a second transistor comprising a first terminal, a second terminal and a control terminal, wherein the first terminal of the second transistor is electrically coupled to the first node, the second terminal of the second transistor is electrically coupled to the second terminal of the first transistor, and the control terminal of the second transistor is configured to receive a compensation control signal.

12. The display device of claim 11, wherein the compensation circuit further comprises:

a third transistor comprising a first terminal, a second terminal and a control terminal, wherein the first terminal of the third transistor is electrically coupled to the first node, the second terminal of the third transistor is configured to receive the second operation voltage, and the control terminal of the third transistor is configured to receive a reset control signal.

13. The display device of claim 9, wherein when the first terminal of the first transistor is configured to receive the first operation voltage, the output circuit comprises:

a fourth transistor comprising a first terminal, a second terminal and a control terminal, wherein the first terminal of the fourth transistor is electrically coupled to the sensing line, the second terminal of the fourth transistor is electrically coupled to the second terminal of the first transistor, and the control terminal of the fourth transistor is configured to receive a output control signal.

14. The display device of claim 9, wherein when the first terminal of the first transistor is configured to receive the first operation voltage, the light sensing circuit comprises:

a fifth transistor comprising a first terminal, a second terminal and a control terminal, wherein the first terminal of the fifth transistor is configured to receive the first operation voltage, the second terminal of the fifth transistor is electrically coupled to the second terminal of the capacitor, and the control terminal of the fifth transistor is configured to receive a compensation control signal; and a light sensing element comprising a first terminal and a second terminal, wherein the first terminal of the light sensing element is electrically coupled to the second terminal of the capacitor, and the control terminal of the light sensing element is configured to receive the second operation voltage.

15. The display device of claim 9, wherein when the first terminal of the first transistor is configured to receive the second operation voltage, the at least one transistor comprises:

a sixth transistor comprising a first terminal, a second terminal and a control terminal, wherein the first terminal of the sixth transistor is electrically coupled to the second terminal of the first transistor, and the control terminal of the sixth transistor is configured to receive a compensation control signal; and a seventh transistor comprising a first terminal, a second terminal and a control terminal, wherein the first terminal of the seventh transistor is electrically coupled to the second terminal of the sixth transistor, the second terminal of the seventh transistor is electrically coupled to the first node, and the control terminal of the seventh transistor is configured to receive the compensation control signal.

16. The display device of claim 15, wherein the compensation circuit further comprises:

a eighth transistor comprising a first terminal, a second terminal and a control terminal, wherein the first terminal of the eighth transistor is configured to receive a reference voltage, the second terminal of the eighth transistor is electrically coupled to the second terminal of the seventh transistor, and the control terminal of the eighth transistor is configured to receive a reset control signal.

17. The display device of claim 9, wherein when the first terminal of the first transistor is configured to receive the second operation voltage, the light sensing circuit comprises:

a fifth transistor comprising a first terminal, a second terminal and a control terminal, wherein the first terminal of the fifth transistor is configured to receive the second operation voltage, the second terminal of the fifth transistor is electrically coupled to the second terminal of the capacitor, and the control terminal of the fifth transistor is configured to receive a compensation control signal; and a light sensing element comprising a first terminal and a second terminal, wherein the first terminal of the light sensing element is electrically coupled to the second terminal of the capacitor, and the control terminal of the light sensing element is configured to receive the first operation voltage.

* * * * *